US005746585A

United States Patent [19]

McDunn et al.

[11] Patent Number: 5,746,585

[45] Date of Patent: May 5, 1998

[54] PERISTALTIC PUMP AND METHOD IN A PERISTALTIC PUMP FOR ADVANCING A TUBE FROM A FIRST POSITION TO A SECOND POSITION

[75] Inventors: Kevin J. McDunn, Lake in the Hills; Linda Limper-Brenner, Glenview; Minoo D. Press, Schaumburg, all of Ill.

[73] Assignee: Motorola, Inc., Schaumburg, Ill.

[21] Appl. No.: 775,325

[22] Filed: Dec. 31, 1996

[51] Int. Cl.[6] ..... F04B 43/08

[52] U.S. Cl. ..... 417/477.11; 417/477.1; 604/153

[58] Field of Search ..... 417/477, 476, 417/477.1, 477.11; 604/153

[56] References Cited

U.S. PATENT DOCUMENTS

| | | | |
|---|---|---|---|
| 3,597,124 | 8/1971 | Adams | 417/477.11 |
| 3,918,854 | 11/1975 | Catarious et al. | 417/477.11 |
| 3,972,649 | 8/1976 | Jutte | 417/477.11 |
| 4,380,236 | 4/1983 | Norton | 417/476 |
| 4,906,168 | 3/1990 | Thompson | 417/477.1 |
| 4,969,808 | 11/1990 | Tsukada | 417/477.1 |
| 5,082,429 | 1/1992 | Soderquist et al. | 417/477.11 |

*Primary Examiner*—Charles G. Freay
*Assistant Examiner*—Peter G. Korytnyk
*Attorney, Agent, or Firm*—Heather L. Creps

[57] ABSTRACT

The peristaltic pump includes a motor and an assembly driven by the motor. The assembly includes a rotating member, a retaining member having a slot, and a tubing advance pad sized to be substantially disposed in the slot, wherein in a first time interval the tubing advance pad is substantially disposed in the slot and the rotating member is configured to compress a tube along a path defined by the retaining member and at least a portion of the tubing advance pad, and in a second time interval the retaining member is configured to release the tubing advance pad from the slot, the tubing advance pad is coupled to the rotating member and the tube is prepared to advance from a first position to a second position.

16 Claims, 3 Drawing Sheets

—PRIOR ART—

10
40
14
41
CONTROLLER
64
62
42
44
46
48
52
54
43
26
22a
22b
22c
24
29
28
18
16
13
11
12
—PRIOR ART—

FIG. 4A
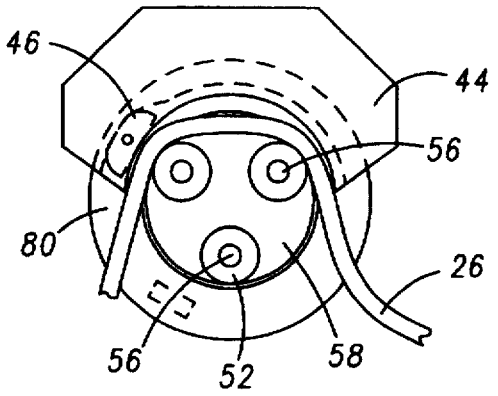
FIG. 4B
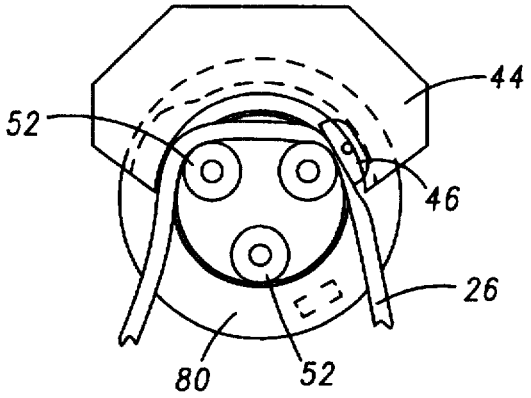
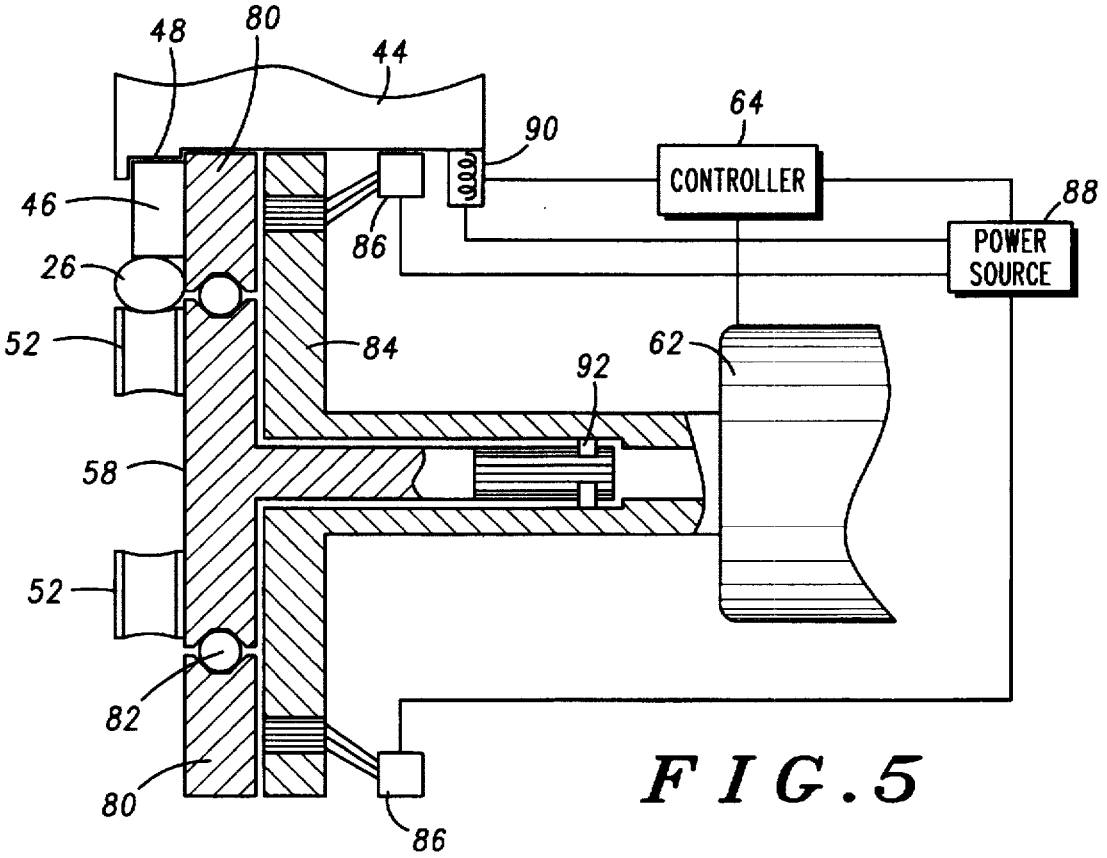
FIG. 5

PERISTALTIC PUMP AND METHOD IN A PERISTALTIC PUMP FOR ADVANCING A TUBE FROM A FIRST POSITION TO A SECOND POSITION

FIELD OF THE INVENTION

The present invention relates generally to fluid pumps, and more particularly, to a peristaltic pump and a method in a peristaltic pump for advancing a tube from a first position to a second position.

SUMMARY OF THE INVENTION

According to an aspect of the present invention, the foregoing needs are addressed by a peristaltic pump which includes a motor and an assembly driven by the motor. The assembly includes a rotating member, a retaining member having a slot, and a tubing advance pad sized to be substantially disposed in the slot, wherein in a first time interval the tubing advance pad is substantially disposed in the slot and the rotating member is configured to compress a tube along a path defined by the retaining member and at least a portion of the tubing advance pad, and in a second time interval the retaining member is configured to release the tubing advance pad from the slot, the tubing advance pad is coupled to the rotating member and the tube is prepared to advance from a first position to a second position.

According to another aspect of the resent invention, the foregoing needs are addressed by an assembly, including, in a first time interval, a retaining member having a slot, a tubing advance pad substantially disposed in the slot, the retaining member and at least a portion of the tubing advance pad defining a path configured to compress a tube when a rotating member rotates along the path; and, in a second time interval, the retaining member configured to release the tubing advance pad from the slot and the tube prepared to advance from a first position to a second position when the tube is secured between the tubing advance pad and the rotating memberan apparatus According to a further aspect of the present invention, a peristaltic pump includes a motor and an assembly for compressing a tube, the assembly driven by the motor and comprising a rotating member and a retaining member, the retaining member having a slot sized to receive a tubing advance pad and the rotating member configured to compress the tube along a path defined by the retaining member and the tubing advance pad, and a method for advancing the tube from a first position to a second position, includes releasing the tubing advance pad from the slot; securing the tube between the tubing advance pad and the rotating member; and rotating, by the rotating member, to cause the tube to advance from the first position to the second position.

BACKGROUND OF THE INVENTION

Peristaltic pumps are used to force fluid through a system by contracting and relaxing flexible tubing containing the fluid. The fluid contacts only the flexible tubing and hence does not contaminate the pump or vice versa. Peristaltic pumps typically include at least two primary parts, a rotor and a motor, which is generally located in a housing. Flexible fluid containing tubing is generally placed between the rotor and a portion of the housing, where the tubing is intermittently occluded by the rotor.

A rotor may include rollers spaced equidistant around the inner circumference of the rotor. A "pillow" of fluid is created between two adjacent rollers which is then pushed forward when the rotor rotates. The flexible tubing behind the rollers recovers its shape, creates a vacuum, and draws more fluid forward, in behind it. Thus, the rollers act like check valves, creating a dynamic seal within the tubing.

The reliability of any pump system is limited by the pump life, and specifically by the wear of the dynamic seals. In a peristaltic pump, flexible tubing acts as the dynamic seal for the pump, and it is a most critical link, subject to wear and eventual failure. Typical peristaltic pumps require regular service to replace or manually advance the flexible tubing, since, due to repeated occlusion and relaxation, the flexible tubing's ability to create a dynamic seal becomes compromised over time.

There is therefore a need for a peristaltic pump which automatically advances a segment of flexible tubing from a first position to a second position to insure that any one section of the tubing does not fail.

BRIEF DESCRIPTION OF THE DRAWINGS

FIGS. 4*a* and 4*b* are a front view of an alternative embodiment of the tube compression assembly of the pump shown in FIG. 5.

FIG. 5 is a side view of a peristaltic pump and the tube compression assembly shown in FIG. 4.

DETAILED DESCRIPTION OF THE PREFERRED EMBODIMENT

Figure 1:
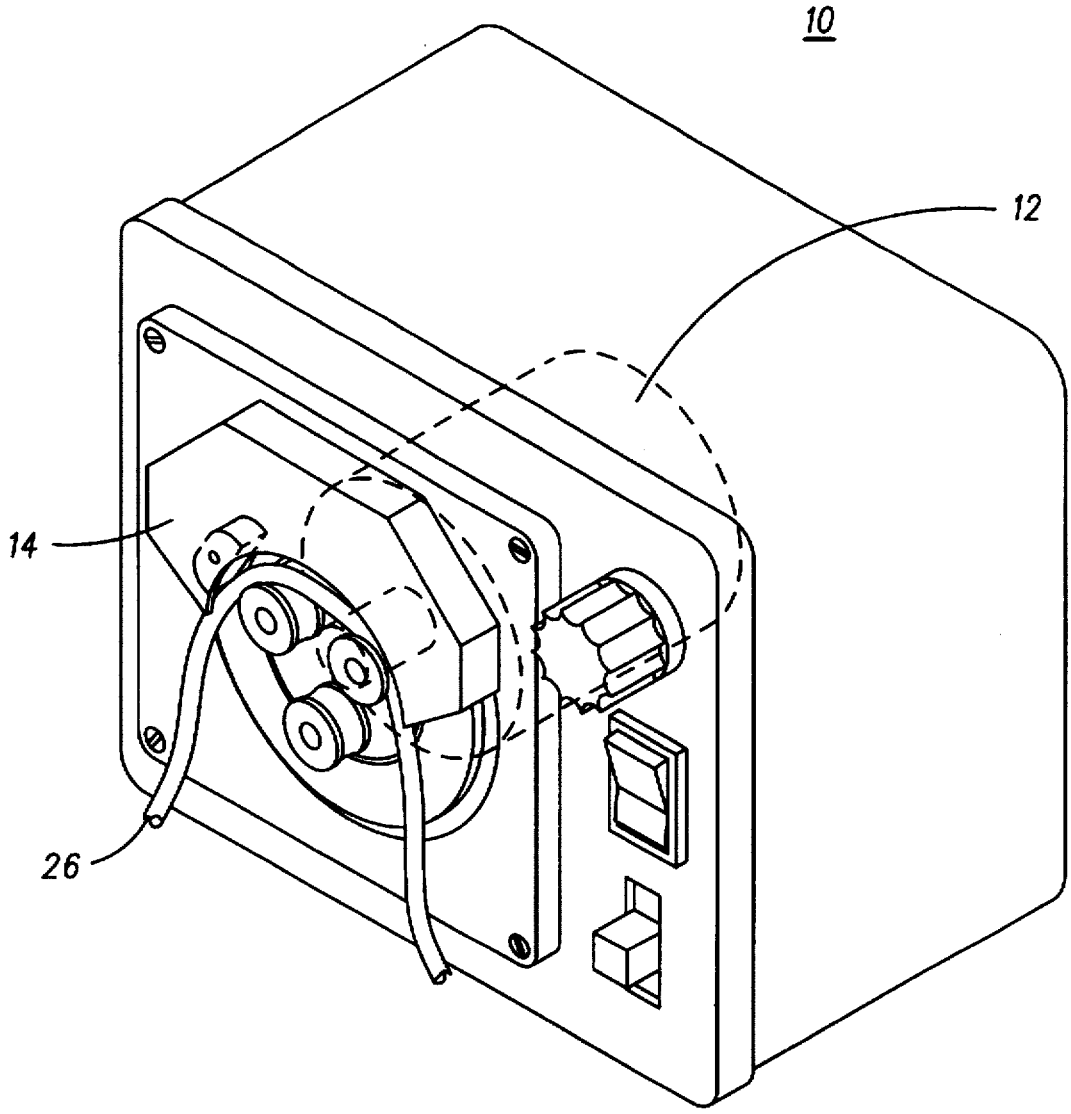
FIG. 1 is a perspective view of a typical peristaltic pump.

Turning now to the drawings, wherein like numerals designate like components, FIG. 1 illustrates a perspective view of a typical peristaltic pump 10. As shown in FIG. 1, peristaltic pump 10 includes an assembly 14, (discussed further below), for compressing a flexible tube 26, and a pump motor 12. Flexible tube 26 may be made of a polymeric material such as Norprene™, Pharmed™ or Tygon™ available from Norton Company, but may be another suitable material, such materials being well-known and widely available. Tube compression assembly 14 is driven by pump motor 12. Pump motor 12 may be a reversible permanent magnet type from Tuthill Pump Company of California, designed for forward and reverse pumping capabilities. As shown in FIG. 1, tube compression assembly 14 is preferably exposed on an outer face of peristaltic pump 10.

Figures 2A, 2B, 2C, 3A, 3B, 3C, 3D:
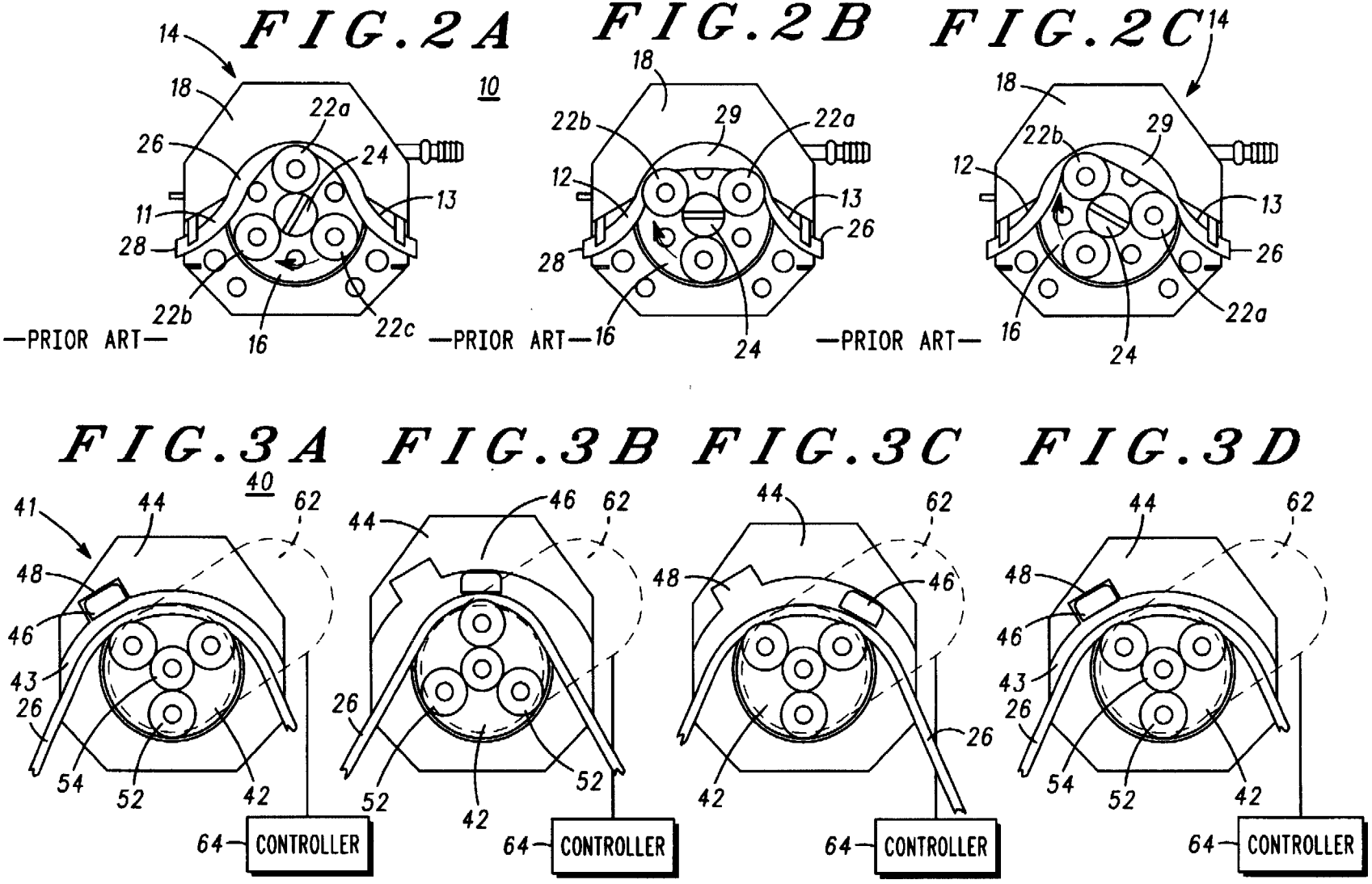
FIGS. 2*a*–2*c* are a front view of a tube compression assembly of the peristaltic pump illustrated in FIG. 1 during normal operation.
FIGS. 3*a*–3*d* depict front views of a tube compression assembly of a peristaltic pump and an operation thereof in accordance with a preferred embodiment of the present invention.

FIGS. 2*a*–2*c* further illustrate how a typical peristaltic pump such as pump 10 in FIG. 1, compresses flexible tube 26, causing fluid to flow. Tube compression assembly 14 typically includes a rotor 16 and a housing 18. Rotor 16 and housing 18 are configured such that they define a path for compressing flexible tubing 26 therebetween, during the operation of peristaltic pump 10. For example, rotor 16 typically includes a series of rollers 22 *a–c*, configured in regular intervals. Rollers 22 *a–c* may be positioned in regular intervals around center hub 24 as shown, or may be positioned over pegs which are rigidly attached to rotor 16. In the case where rollers *a–c* are positioned over pegs, center roller holes are sized to allow free-spinning action of the rollers about pegs. In both well-known configurations of rotor 16 and rollers 22 *a–c*, the rotation of rotor 16 causes the surface of rollers 22 *a–c* to pinch flexible tubing 26 against a portion of housing 18.

In a first view, fluid 28 enters tube compression assembly 14 at an inlet point 11, and exits at an outlet point 13. Initially, fluid 28 is drawn forward as roller 22*a* engages the surface of flexible tubing 26, occluding it.

In a second view, roller 22*a* rotates forward across the surface of flexible tubing 26 while roller 22*b* engages the surface of flexible tubing 26, thereby creating a fluid pillow, 29. Flexible tubing 26 behind roller 22*a* recovers its shape and the resulting vacuum draws fluid 28 forward.

In a final view, fluid pillow 29 is propelled forward and is subsequently released from tube compression assembly 14, as roller 22*a* passes outlet point 13.

In this manner, fluid is pumped by the contraction and relaxation of flexible tubing 26 between rotor 16 and at least a portion of housing 18. Generally, flexible tubing 26 is fastened to tube compression assembly 14 until it is replaced or manually advanced.

FIGS. 3*a–*3*d* show is a tube compression assembly 41 of a peristaltic pump in accordance with a preferred embodiment of the present invention. Tube compression assembly 41 includes a rotating member 42 and a retaining member 44, configured to define a path 43 for compressing flexible tubing 26 therebetween. Rotating member 42 is coupled to, and thus responsive, to pump motor 62 (shown in first view only).

Rotating member 42 includes a series of rollers 52, configured at regular intervals on the surface of rotating member 42. As shown, rollers 52 are disposed around center hub 54, although center hub 54 need not be present. For example, rotating member 42 may be configured as in FIG. 4, to include a series of rollers 52, center axis mounted on rigid pegs 56, pegs 56 accommodating free spinning of rollers 52. Then, rollers 52 rotate to apply a low tangential friction force and a normal compression force on flexible tubing 26 as they spin about pegs 56.

In a further example, rotating member 42 may have another configuration altogether, for example, a multilobular rotating member (not shown) coupled to pump motor 62, in which flexible tubing 26 is intermittently compressed by the outer lobe surfaces of the multilobular rotating member as it rotates.

In any configuration, as rollers 52 move, they intermittently pinch the fluid filled flexible tubing 26 against a portion of retaining member 44 as described in connection with FIGS. 2*a–*2*c*. In this manner, fluid is pumped by the contraction and relaxation of flexible tubing 26 between rollers 52 and at least a portion of retaining member 44.

Returning again to FIGS. 3*a–*3*d*, a depression 48 such as a slot is disposed in retaining member 44, substantially positioned along path 43. Slot 48 is sized to receive a tubing advance pad 46 and may be, for example, a rectangular shape. Tubing advance pad 46 may be made of a high friction material such as rubber, or may be another material such as metal or plastic. Tubing advance pad 46 is coupled to pump motor 62 via a clutch mechanism (discussed further below). During pump operation, tubing advance pad 46 is substantially recessed into slot 48, such that the surface of tubing advance pad 46 is approximately flush with the surface of retaining member 44.

In a first view, at a first time, a controller 64 (discussed further below) determines that flexible tubing 26 should be advanced from a first position to a second position because, for example, it has reached it's maximum number of cycles. Controller 64 may be in communication with pump motor 62 and controller 64 may also be in communication with a counter (not shown). The counter may be responsive to the number of revolutions of rotating member 42, or alternately to pump motor 62 operation time.

In a second view, at a second time, in response to a command from controller 64, pump motor 62 pauses, so that one roller 52 is substantially aligned with tubing advance pad 46, compressing flexible tubing 26 between advance pad 46 and roller 52. Next, retaining member 44 releases tubing advance pad 46 from slot 48. Retaining member 44 may release pad 46 by lifting, for example, in response to an energized solenoid (not shown, discussed further in connection with FIG. 5).

In a third view, pump motor 62, engages tubing advance pad 46, by way of a clutch or similar element (discussed further in connection with FIG. 5), so that tubing advance pad 46 becomes responsive, to pump motor 62. Subsequently, pump motor 62 advances roller 52 and tubing advance pad 46 forward, with flexible tubing 26 therebetween. Consequently, flexible tubing 26 advances forward to a position which may be determined by controller 64.

Upon reaching its destination position, tubing advance pad 46 is decoupled from pump motor 62 and returns back to its initial position as shown in a fourth view. Advance pad 46 may be returned to its initial position by, for example, a spring or a magnetic means. Subsequently, retaining member 44 is returned to a position for pump operation such that tubing advance pad 46 is substantially disposed in slot 48.

In an alternate embodiment, tubing advance pad 46 may be disposed on an advance pad ring 80 as depicted in FIGS. 4*a* and 4*b*. As in FIGS. 3*a–*3*d*, pad 46 may also be disposed in slot 48 in retaining member 44. Advance pad ring 80 may be concentrically disposed about rotating member 42.

FIG. 5 depicts a side view of the apparatus shown in FIGS. 4*a* and 4*b* along with elements of a peristaltic pump. Rotating member 42 is coupled to pump motor 62 via a forward ratchet clutch 92 ratchet clutches being well known in the art. Advance pad ring 80 is magnetically coupled to electromagnetic clutch 84. Two brush contacts 86, configured to substantially contact electromagnetic clutch 84, are responsive to power source 88. Activation of power source 88 couples electromagnetic clutch 84 to advance pad ring 80, and may be engaged, for example, when it is desired to operate advance pad ring 80 to move flexible tube 26 to a new position as discussed in connection with FIG. 3.

A solenoid 90, coupled to retaining member 44 and responsive to controller 64, is deactivated during normal pump operation.

As discussed in connection with FIG. 3, when controller 64 determines that flexible tubing 26 should be advanced from a first position to a second position, pump motor 62 is paused such that one roller 52 is substantially aligned with tubing advance pad 46, and solenoid 90 is activated, lifting retaining member 44 and releasing tubing advance pad 46 from slot 48. Substantially concurrently, controller 64 activates electromagnetic clutch 84 to engage advance pad ring 80 via brush contacts 86. Controller 64 advances pump motor 62 forward, rotating advance pad ring 80 in concert with rotating roller disk 58, one of rollers 52 and tubing advance pad 46 compressing flexible tubing 26 therebetween. Consequently, flexible tubing 26 advances forward to a predetermined position.

Upon reaching a second position such as shown in FIG. 4*b*, second view, pump motor 62 may reverse, returning advance pad ring 80 to its original position. Alternately, pump motor 62 may continue forward until advance pad 46 is aligned with slot 48. Finally, solenoid 90, may be deactivated, allowing retaining member 44 to drop down over advance pad 46, and may be deactivated so that advance pact ring 80 is released. Then, normal pumping may resume using a new segment of flexible tubing 26.

It will be apparent that other and further forms of the invention may be devised without departing from the spirit and scope of the appended claims and their equivalents, and it will be understood that this invention is not to be limited in any manner to the specific embodiments described above, but will only be governed by the following claims and their equivalents.

We claim:

1. A peristaltic pump comprising:

a motor; and an assembly driven by the motor, the assembly comprising:

a rotating member;

a retaining member having a slot; and a tubing advance pad sized to be substantially disposed in the slot, wherein in a first time interval the tubing advance pad is substantially disposed in the slot and the rotating member is configured to compress a tube along a path defined by the retaining member and at least a portion of the tubing advance pad, and in a second time interval the retaining member is configured to release the tubing advance pad from the slot, the tubing advance pad is coupled to the rotating member and the tube is prepared to advance from a first position to a second position.

2. The peristaltic pump according to claim 1, wherein in the first time interval the tubing advance pad is coupled to the retaining member.

3. The peristaltic pump according to claim 1, wherein the rotating member comprises a plurality of rollers.

4. The peristaltic pump according to claim 1, further comprising:

a solenoid, the solenoid configured to move the retaining member, releasing the tubing advance pad from the slot.

5. The peristaltic pump according to claim 1, further comprising:

a clutch, the clutch coupling the tubing advance pad and the rotating member.

6. The peristaltic pump according to claim 5, wherein in a third time interval, the motor is configured to return the tubing advance pad to the slot.

7. The peristaltic pump according to claim 1, further comprising:

a ring, the tubing advance pad disposed on the ring.

8. The peristaltic pump according to claim 1, wherein the ring is concentrically disposed about the rotating member.

9. An assembly, comprising:

in a first time interval:

a retaining member having a slot, a tubing advance pad substantially disposed in the slot, the retaining member and at least a portion of the tubing advance pad defining a path configured to compress a tube when a rotating member rotates along the path; and in a second time interval:

the retaining member configured to release the tubing advance pad from the slot and the tube becomes prepared to advance from a first position to a second position when the tube is secured between the tubing advance pad and the rotating member.

10. In a peristaltic pump comprising a motor and an assembly for compressing a tube, the assembly driven by the motor and comprising a rotating member and a retaining member, the retaining member having a slot sized to receive a tubing advance pad and the rotating member configured to compress the tube along a path defined by the retaining member and the tubing advance pad, a method for advancing the tube from a first position to a second position, the method comprising the steps of:

releasing the tubing advance pad from the slot;

securing the tube between the tubing advance pad and the rotating member; and rotating the rotating member, by the motor to cause the tube to advance from the first position to the second position.

11. The method according to claim 10, wherein the step of securing comprises engaging a clutch.

12. The method according to claim 10, further comprising the step of:

prior to the step of releasing, detecting that the tube should be advanced.

13. The method according to claim 12, wherein the step of detecting comprises counting a predetermined number of hours of operation of the peristaltic pump.

14. The method according to claim 12, wherein the step of detecting comprises counting a predetermined number of rotations by the rotating member.

15. The method according to claim 10, wherein step of releasing comprises moving the retaining member.

16. The method according to claim 10, further comprising the step of:

after the step of rotating the rotating member, returning the tubing advance pad to the slot.

* * * * *